US005711353A

United States Patent [19]

Ichikawa et al.

[11] Patent Number: 5,711,353

[45] Date of Patent: Jan. 27, 1998

[54] POWDER FILLING METHOD AND POWDER FILLING DEVICE

[75] Inventors: Hideo Ichikawa; Sunao Ikeda, both of Numazu; Michiharu Narushima, Shimizu; Nobuhiro Makita, Numazu, all of Japan

[73] Assignee: Ricoh Company, Ltd., Tokyo, Japan

[21] Appl. No.: 589,003

[22] Filed: Jan. 19, 1996

[30] Foreign Application Priority Data

Jan. 26, 1995 [JP] Japan ..... 7-010910

[51] Int. Cl.[6] ..... B65B 1/04

[52] U.S. Cl. ..... 141/67; 141/12; 141/73; 53/405

[58] Field of Search ..... 141/12, 59, 70, 141/71, 73, 80, 67; 53/405, 408, 403, 432, 510, 79, 527, 523, 436; 366/139, 191

[56] References Cited

U.S. PATENT DOCUMENTS 773,877 11/1904 Lorillard ..... 141/73

2,524,560 10/1950 Cote ..... 141/12

2,842,465 7/1958 Harrison ..... 366/191

4,974,646 12/1990 Martin et al. ..... 141/67

*Primary Examiner*—Henry J. Recla

*Assistant Examiner*—Steven O. Douglas

*Attorney, Agent, or Firm*—Oblon, Spivak, McClelland, Maier & Neustadt, P.C.

[57] ABSTRACT

A powder filling method and a powder filling device for filling a powder such as toner, chemical, cosmetics or food material in a powder container efficiently at a high density includes the steps of inserting an air aspirating pipe in a powder filled in a powder container, aspirating air in the powder through the air aspirating pipe, and moving one end of the air aspirating pipe from a bottom portion to a top portion of the powder container, corresponding to an amount of the powder filled.

8 Claims, 6 Drawing Sheets

POWDER FILLING METHOD AND POWDER FILLING DEVICE

BACKGROUND OF THE INVENTION

1. Field of the Invention

The present invention generally relates to a powder filling method and a powder filling device, and more particularly to a powder filling method and a powder filling device for filling a powder such as toner, chemical, cosmetics or food material in a powder container.

2. Description of the Related Art

Various type of powder filling methods and powder filling devices have been known so far. In an example thereof, powder is weighed and extruded by a turning auger having a rotational axis and a spiral blade.

FIG. 1 shows a conventional powder filling device using such an auger. A container 1' in which powder is filled may be a cartridge when the powder is a toner for a photocopying device or a printer, a glass or plastic bottle when the powder is cosmetics or food material, or a plastic bag.

After the powder is filled in a hopper 17 having an auger 21 from a bigger hopper or a container, a predetermined amount of powder is weighed and filled by the turning auger in the powder container 1', moving on the conveyer 19, from an opening formed in the bottom of the hopper through a funnel. A turning speed of the auger is controlled by a motor 20 based on a volume of a powder container 1' determined in advance in order to fill a predetermined amount of powder. The powder container in which the powder is filled is weighed and compared with an empty container. If the difference between the filled container and the empty container is not in a certain range, the filled container is excluded.

However in the conventional powder filling device, since it requires a long time for the powder to sink in the container, the filling efficiency is not high and a powder is not filled with a high density. Also, since the auger is used, a filling amount is not sufficiently accurate. Further, due to a friction between thee turning auger and the powder, the powder particles may possibly be bridged or joined to other powder particles so as to form flakes, especially when a powder to be filled is toner.

In order to solve the above problems, a powder filling device shown in FIG. 2 is proposed in which air in the powder container is aspirated so as to fill the powder in the container at a high density. In this type of powder filling device, a powder supplying pipe 25 supplying the powder is removably connected to a powder inlet 22 of the powder container 1'. In the powder supplying pipe 25, an air aspirating pipe 23 is provided. On one end of the air aspirating pipe 23 extended in the powder container 1', a perforated element 24 as an air separating means is provided in order to aspirate the air from the powder. The other end of the air aspirating pipe 23 is connected to a decompression source (not shown).

The powder is supplied to the powder container 1' through the powder supplying pipe 25. After the predetermined amount of the powder is supplied in the powder container 1', the air in the powder container 1' is aspirated from the perforated element 24 to the air aspirating pipe 23 by the decompression source. The aspirated air is introduced to the outside of the device. After the powder is filled in the container 1', the air aspirating pipe 23 together with the powder supplying pipe 25 is removed from the powder inlet 22 and the powder inlet 22 is closed by a cap.

However, though the air aspiration from the powder container is conducted efficiently around the perforated element 24, it is not conducted in the upper portion of the powder container, which is not adjacent to the perforated element 24. That is, the density of the powder around the perforated element 24 is high, but the density in the upper portion is not so high since the air therein is not sufficiently aspirated. Thus, the density in the powder container is not even and the filling amount of the powder is insufficient. When aspiration of the powder is increased to increase the density, the powder particles may possibly be bridged or fused and solidified and removal of the air aspirating pipe 23 is difficult. Also, with this device, the container should have a large powder inlet. Thus, capping the powder inlet is difficult.

Especially when the powder container is a toner cartridge used for an imaging device such as a printer or a facsimile, the density of the toner is required to be increased in order to reduce size and production cost thereof and to improve service life and operational characteristics thereof.

SUMMARY OF THE INVENTION

Accordingly, it is a general object of the present invention to provide a novel and useful powder filling method and a powder filling device in which a powder can be filled in a smaller powder container accurately and evenly at a high speed and a high density.

Another object of the present invention is to provide a powder filling method and a powder filling device in which a filling process can be automated without an operator contacting the powder.

As the result of research, the present inventors have found that the above object is achieved by an air aspirating pipe moving from the bottom to the top in the powder container, responding to the amount of the powder when the powder is filled. Also, the present inventors have found that blowing air to the hopper or the funnel increase the advantages.

The above objects of the present invention are achieved by a powder filling method, including the steps of inserting an air aspirating pipe in a powder container filled with a powder, aspirating air in the powder through the air aspirating pipe, and moving one end of the air aspirating pipe from the bottom portion to the top portion of the powder container, corresponding to the amount of the powder filled in the container.

The above invention may further include the steps of connecting airtightly one of a hopper and a funnel to the powder container through a nozzle, one of the hopper and the funnel being filled with the powder, one of the hopper and the funnel having a discharge hole at a bottom thereof connected to the powder container through the nozzle, blowing air from a wall of the nozzle into the powder container, filling the powder container from one of the hopper or the funnel, and aspirating the air in the powder container through the air aspirating pipe inserted through a hole formed in the powder container.

The above objects of the present invention is also achieved by a powder filling device comprising a powder container having a powder inlet and an air aspirating pipe insertion hole, an air aspirating pipe positioned in the powder container, the air aspirating pipe having an air separating portion having a plurality of pores for separating air in the power in the powder container, and means for moving the air separating portion from the bottom portion to the top portion of the powder container.

The above invention may further include a nozzle having a plurality of pores for blowing air, and one of a hopper and a funnel connected airtightly to the powder container through the nozzle, one of the hopper and the funnel being filled with the powder, one of the hopper and the funnel having a discharge hole at a bottom thereof connected to the powder container through the nozzle.

The above invention may further include a sieve or a filter provided around the air separating portion.

In the above invention, the powder inlet of the powder container may have a diameter less than 6 mm and the air aspirating pipe insertion hole may have a diameter less than 6 mm.

The above invention may further include a compressed air source connected to said air aspirating pipe, said compressed air source providing compressed air to said air separating portion through said air aspirating pipe.

In the above invention, the powder may be a toner.

According to the invention, since the air aspirating portion moves from the bottom to the top in the powder container corresponding to the amount of powder filled, the powder can be filled at a high speed at a high density even in a small container. Also, by blowing air from the wall of the nozzle, filling speed of the container may be increased. In addition to that, by a reduced pressure inside the powder container, the powder can be filled at a higher speed at a higher density. The powder is also prevented to being stuck in the hopper.

By providing a filter around the air separating portion, a clogging of the air aspirating pipe is prevented and the filling speed can be further improved.

Further, the powder may be filled in a powder container having a small powder inlet and an air aspirating pipe insertion hole. Therefore, a photocopying device or a facsimile device using such a container as a toner cartridge may be reduced in size. Also, service life thereof may be improved.

Also, when compressed air is provided to the air separating portion, the toner flakes formed during a filling operation may be broken and the clogging of the sieve or the filter provided around the air separating portion may be prevented.

Moreover, the present invention may be fully automated by using a turn table. All operations are conducted by a compressed pressure and a decompressed pressure instead of a mechanical system. Thus, the powder is prevented from becoming flakes and danger of a dust explosion is avoided. Also, an amount of powder is accurately filled each of the powder container.

As described above, the present invention has a high industrial utility value.

Other Objects and further features of the present invention will be apparent from the following detailed description when read in conjunction with the accompanying drawings.

DESCRIPTION OF THE PREFERRED EMBODIMENTS

The preferred embodiments of the present invention will now be described in further detail with reference to the accompanying drawings.

FIGS. 3–6 shows a powder filling device of the present invention.

Figure 1:
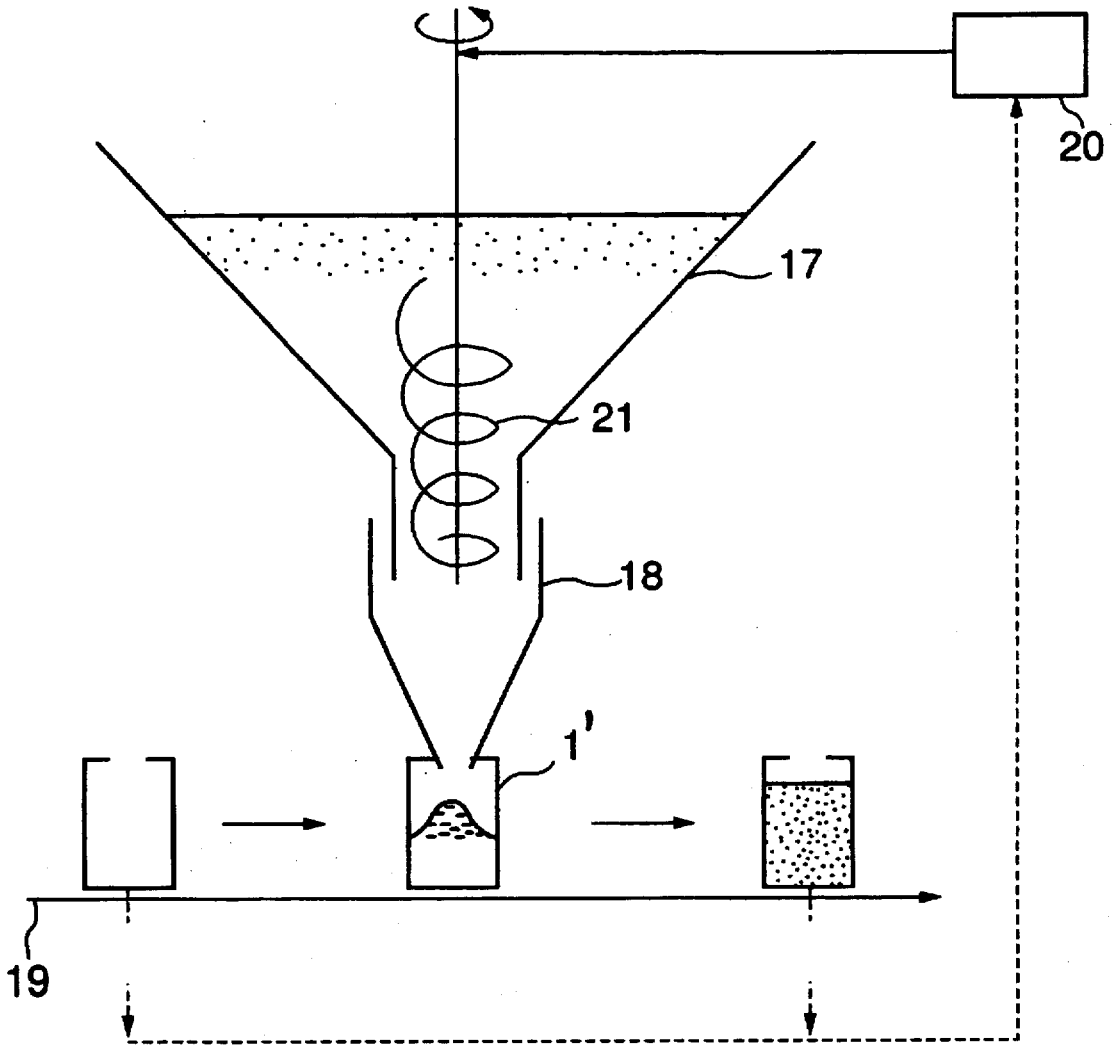
FIG.1 PRIOR ART
FIG. 1 is a schematic illustration showing a conventional powder filling device.
Figure 2:
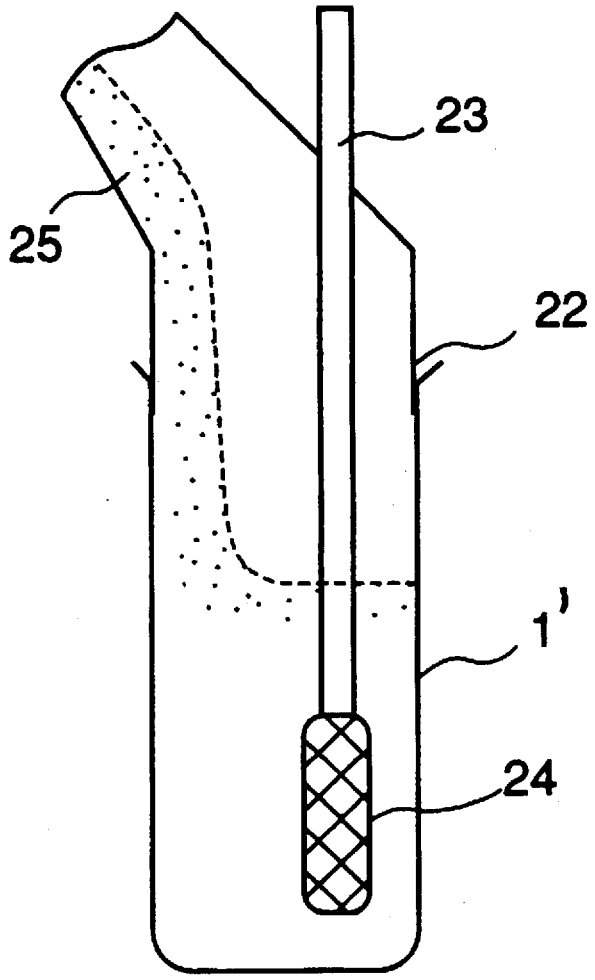
FIG.2 PRIOR ART
FIG. 2 is a schematic illustration showing another conventional powder filling device.
Figure 3:
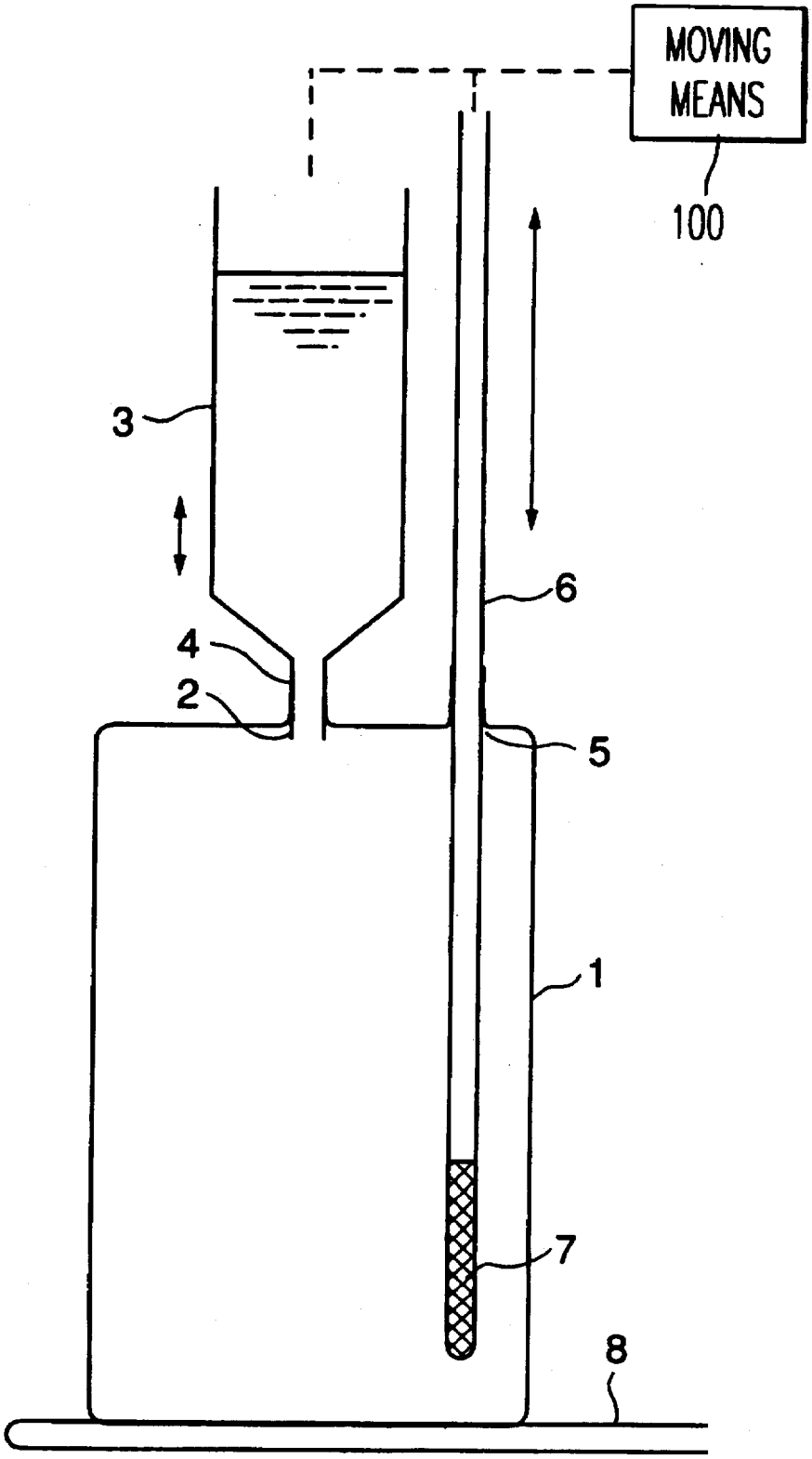
FIG. 3 is a schematic illustration showing a powder filling device of the present invention.

In FIG. 3, a powder container 1 is provided in which a toner as an example of a powder is filled on a turn table 8. In the powder container 1, a powder inlet 2 and an air aspirating pipe insertion hole or inlet 5 is formed. In the powder filling device, a hopper (not shown) is provided at a predetermined position, from which a toner is provided directly or through a funnel 3. Under the hopper or the funnel 3, a powder supplying pipe 4 is provided, which can be removably inserted in the powder inlet 2. The hopper or the funnel 3 is connected to a piston rod (not shown) of an air cylinder. The hopper or the funnel moves up and down by driven by the air cylinder in order that the powder supplying pipe 4 is inserted into the powder inlet or removed therefrom. On the outer surface of the powder supplying pipe 4, a flange (not shown) is formed in which a gasket is fixed. When the powder supplying pipe 4 is inserted into the powder inlet 2, the gasket tightly seals the powder inlet.

Over the hopper or the funnel 3, a measuring portion (not shown) is provided to measure an amount of toner supplied to the hopper or the funnel 3. The measuring portion usually includes a measuring cylinder, an air cylinder and a controlling rod. The measuring portion may be incorporated in the hopper or the funnel or may be provided separately.

In the powder container 1, an air aspirating pipe 6 is provided penetrate through the air aspirating pipe insertion inlet 5. The air aspirating pipe 6 is located exteriorly of the hopper or the funnel 3. The air aspirating pipe 6 includes a circular, hollow pipe extending inside the powder container and an air separating portion 7 provided at a tip end of the air aspirating pipe 6. The other end of the air aspirating pipe 6 is connected to a decompression source or a compression air source through a reversible three-direction valve or a branched valve.

The air separating portion 7 has a plurality of pores through which the air between particles of the powder is aspirated. It is preferred that a fine mesh sieve or a filter is provided around the air separating portion 7. The sieve or the filter used is not limited to a particular one, however, it is selected in consideration of a chemical or physical nature or a particle size of the powder. Examples of the sieve or the filter include, but are not limited to, a metal, paper, cloth, nonwoven or perforated ceramics.

The air aspirating pipe may be an independent parts or may be fixed to the hopper or the funnel 3.

The toner is filled in the powder container 1, when the powder container is set under the hopper or the funnel 3. By an operation of the air cylinder acting as a moving means 100, the hopper or the funnel 3 descends and the powder supplying pipe 4 is inserted into the powder inlet 2. With the descent of the hopper or the funnel 3, the air aspirating pipe 6 descends and is inserted in the air aspirating pipe insertion inlet 5. The hopper or funnel 3 may move independently of the air aspirating pipe 6 or may be connected for simultaneous movement. When the powder supplying pipe 4 is inserted into the powder inlet 2, the gasket is compressed in the powder inlet 2. The air separating portion 7 is located in the bottom of the powder container 1.

After that, the air cylinder is driven, and a predetermined amount of the toner in the measuring cylinder is poured in the hopper or the funnel. The toner is filled in the powder container 1 through the hopper or the funnel.

Figure 4:
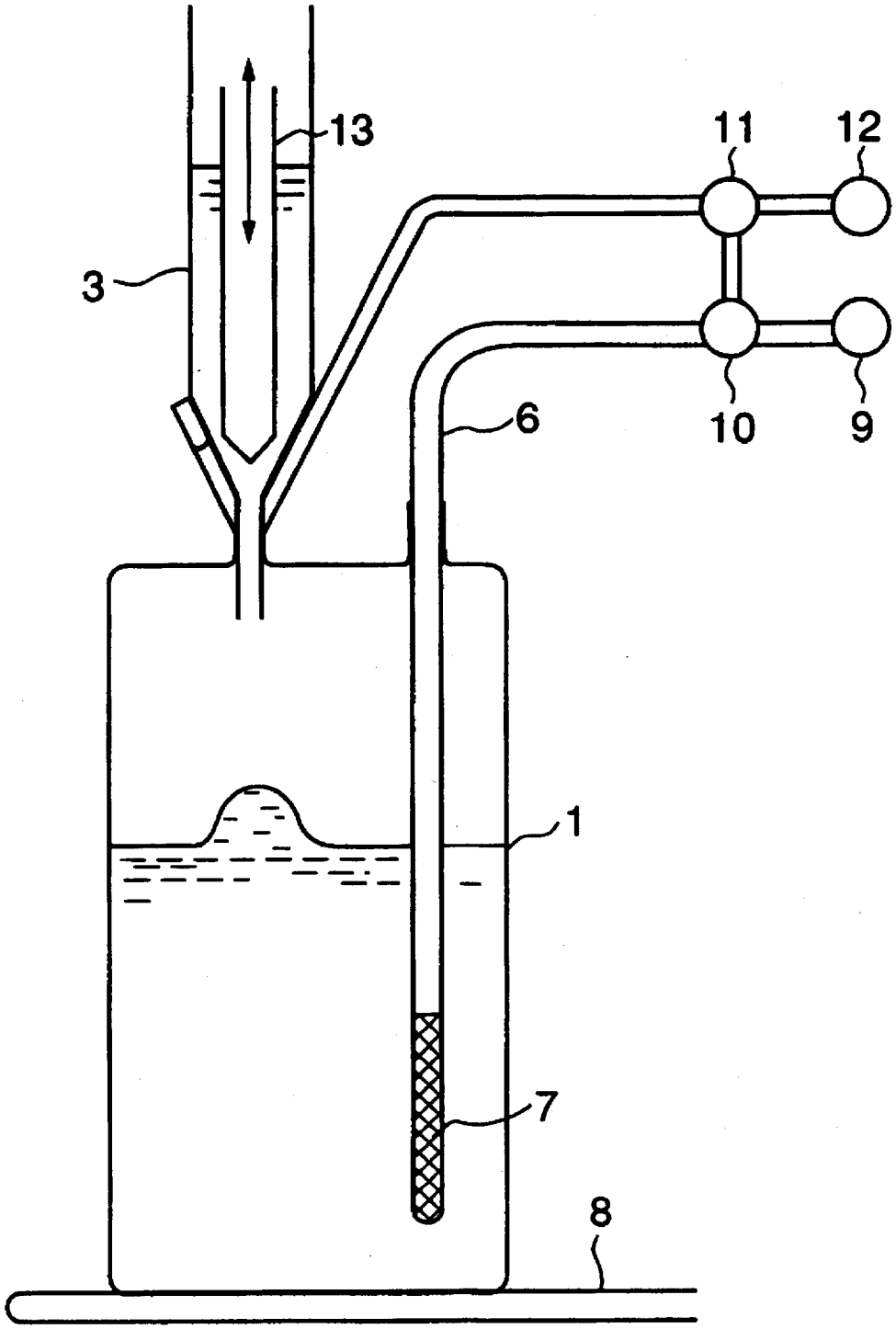
FIG. 4 is a schematic illustration showing an embodiment in which air is blown from a nozzle.

FIG. 4 shows filling steps. When filling of the toner is started by driving the air cylinder, the decompression source is driven and the air aspirating pipe 6 is connected to the decompression source by switching control valves 10, 11. The air in the powder container 1 is aspirated by the air separating portion 7 and the air in the hopper or the funnel 3 is aspirated into the powder container 1. Therefore, just after the operation is started, the toner is filled smoothly from the hopper or the funnel 3 to the powder container with an air current. After a certain amount of the toner is filled in the powder container 1, the air contained in the toner and transferred into the powder container 1 is separated from the toner and aspirated by the air separating portion 7. Thus, air content of the in the toner filled in the powder container 1 is lowered, a filling ratio and the filling amount of the toner is increased. The time required for the operation is shorted and the operational efficiency is improved.

As for the relationship between decompression, filling time and toner density, when a decompression pressure is high, the filling time is shorted and the toner density is increased. However, when the toner density reaches a specific point, the toner is partially bridged or fused and solidified, and fluidity of the toner is lowered, which may lead to a deterioration of an image formed by the toner. Generally, a suitable toner can be prepared without air aspiration and left alone for at least one day after filled. When the aspirated toner density is 0.2 higher than that of the suitable toner, the toner is partially solidified. When the aspirating pressure is between −600 mm Hg and −50 mm Hg, the toner is suitably filled in the container. The aspirating pressure may be constant or varied. The aspiration may be conducted intermittently.

The air aspiration is conducted at first at the bottom of the powder container. After the air aspiration at the bottom of the powder container, the air aspirating pipe 6 is moved upward to conduct the air aspiration at a position where air aspiration has not been sufficient. With the air aspirating pipe moving upward, the air is aspirated from the bottom to the top in the powder container 1. After the powder is filled to a target amount and the air therein is aspirated, the air aspirating pipe 6 is removed from the air aspirating pipe insertion hole 5. Also, the powder supplying pipe 4 is removed. The powder inlet 2 and the air aspirating pipe insertion hole 5 are closed.

As a result, the time required for filling can be shorted and the powder density can be improved. The toner weight (g) per a unit volume of the powder container (ml) depends on a specific gravity of the toner. When the toner used is an iron toner, it can be increased to 0.7–0.8. Comparing to the conventional powder filling method in which air aspiration is not conducted or air aspiration is conducted at only a fixed position, the filling amount of the toner or the service time of the powder container is improved and the powder container and the photocopying machine using the container are reduced in size.

After the toner is filled in the powder container 1, the powder supplying pipe 4 and the air aspiration pipe 6 are removed from the powder inlet 2 and the air aspirating pipe insertion hole 5 by an upward movement of the air cylinder. As described above, the air separating portion 7 has a plurality of pores formed in the pipe and the sieve around the pipe. The outer diameter thereof is the same as that of the air aspirating pipe 6. Therefore, when the air separating portion 7 is removed from the toner filled in the powder container 1, the air separating portion does not scatter the powder and the toner is prevented from being leaked from the air aspirating pipe insertion hole 5.

The compressed air source provides compressed air to the air separating portion 7 to break toner flakes or to unclog the sieve. The decompression source 9 and the compression source 12 are controlled by control valves 10, 11.

Figure 5:
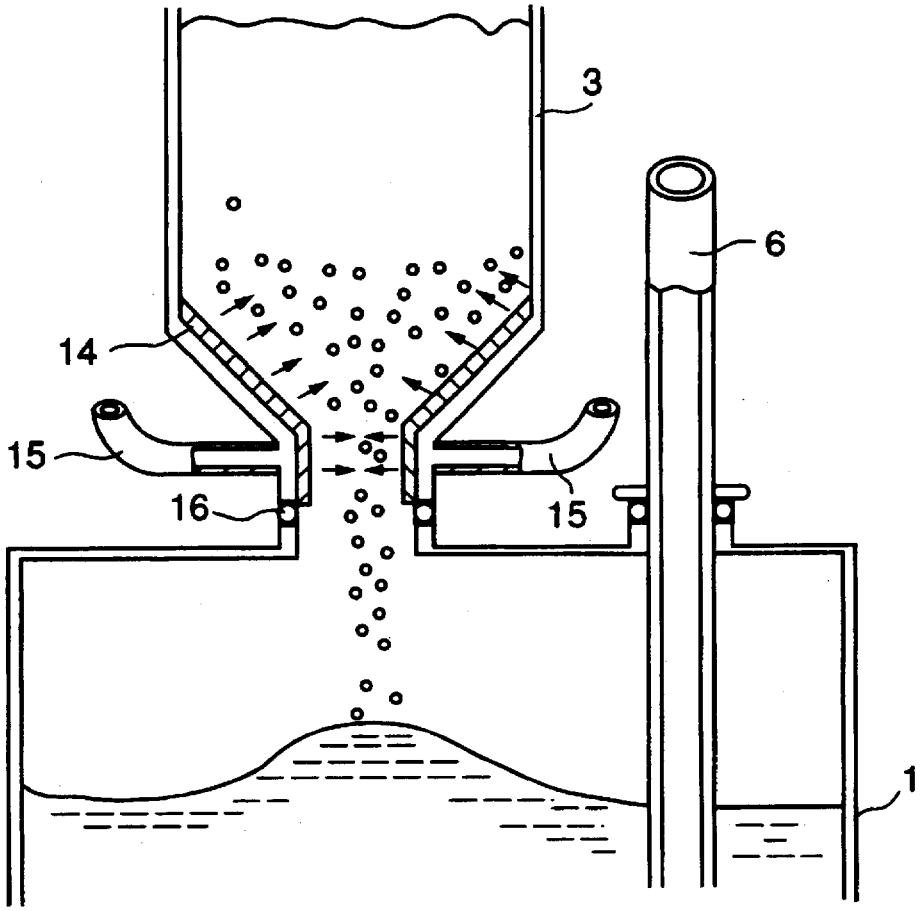
FIG. 5 is an enlarged view of FIG. 4.

The amount of the powder filled from the hopper and the funnel is controlled by vertical movement of the control rod 13. When the magnetic toner is used, a magnet control rod having a magnet at a tip end is proffered as the control rod. FIG. 5 is an enlarged view showing the bottom of the hopper or the funnel 3 and the powder container 1. A vent inner wall 14 is preferably provided on the bottom side an inner wall of the hopper or the funnel 3. A nozzle portion of the hopper or the funnel 3 and the powder container 1 is sealed by a sealing member 16 such as a rubber packing.

By sending air through the vent inner wall 14, the powder is convected to increase the flowability and the operation can be conducted efficiently. By preventing the toner from bridging, the hopper or the funnel can be made larger. In order to handle material easily influenced by a heat, such as toner, chemicals or food material, by adjusting the temperature of the air blown through the inner wall 14, the powder can be heated or cooled regardless of the room temperature.

The air from the compressed air source 12, through a pipe 15, flows into the hopper or the funnel 3 through pores of the vent inner wall 14. One example of the vent inner wall 14 is a vent sinter material. In an example, a sinter is made from particles of average particle size 50–20 μm having a density 6.6–7.4 g/cc. The particle may have a spherical shape or a non-spherical shape. However, particle of the spherical shape are preferred. A main component of the sinter is a metal such as copper or iron, or ceramics. The vent inner wall is not limited to the specific one set forth here. However, the vent inner wall should be a perforated element having pores of 5–75 μm, preferably 20–50 μm in average pore size.

It is also preferred that a vent portion 14 is provide on a wall of the toner outlet of the hopper and the wall of the toner outlet has pores on which a mesh is provided to provide the air filter structure. A size of the mesh provided on the pores is smaller than the toner particle size. A diameter of the pore is 2–75 μm, preferably 20–50 μm. The mesh used is #3000–#2000.

An amount of air supplied may be constant or varied. The air may be supplied intermittently. By supplying the air to the powder supplying portion, the powder density is reduced and the powder flowability is increased. The powder can be filled from the hopper or the funnel at a higher speed. Further, by the air aspiration, more powder can be filled and the powder container and the imaging device using the container can be reduced in size.

In the powder filling device and the powder filling method of the present invention, the powder container has the powder inlet 2 and the air aspirating pipe insertion hole 5. For a toner disc cartridge as the powder container, when the powder container having the powder inlet 2 and the air aspirating pipe insertion hole 5 is reduce in size, a toner supplying unit is reduced in size, which leads to a miniaturization of photocopying machines and facsimile machines. By reducing the toner supplying inlet in size, the toner is prevented from scattering, which improves operational characteristics. The diameter of the powder inlet 2 and the air aspirating pipe insertion hole 5 may be made less than 6 mm, preferably 5 mm.

Figure 6:
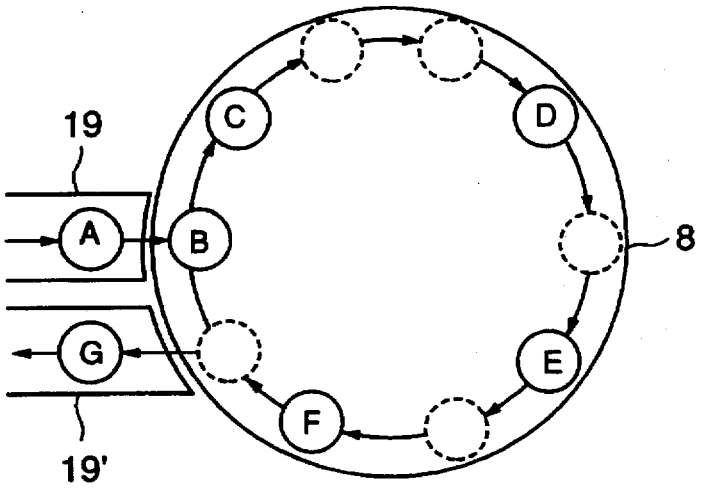
FIG. 6 is a plan view showing a turn table for the device.
Figure 7:
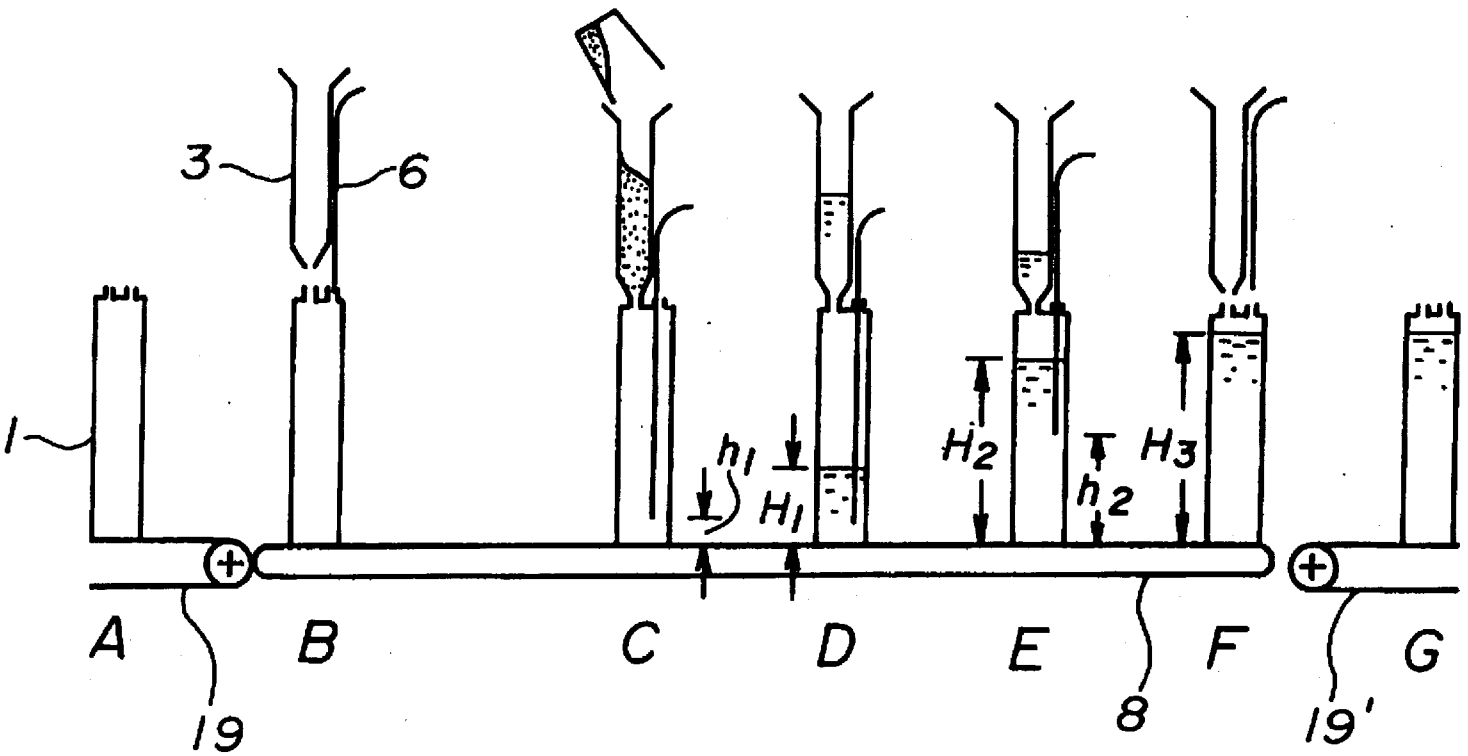
FIG. 7 is a side view of FIG. 6.

The powder filling device and the powder filling method of the present invention may be automated. FIGS. 6 and 7 are schematic illustration showing an example of the automated device. FIG. 6 is a plan view showing a turn table 8. The powder container 1 fed on the belt conveyer 19 moves from a position A to a position B on the turn table. After the powder container moves through positions A-B-C-D-E-F with a clockwise rotation of the turn table 8, the powder container moves to the position G on the belt conveyer 19.

FIG. 7 shows the powder container at each of the positions B, C, D, E, F. At the position B, the funnel and the air aspirating pipe 6 is set on an upper face of the powder container. At the position C, the powder is poured to the funnel 3 and the air aspirating pipe is introduced at a height $h_1$. At this time the powder flows from the funnel 3 to the powder container 1. When the powder filled in the container reaches a height $H_2$, the air aspirating pipe 6 moves to a height $H_2$ at the position E. When the powder reaches a height $H_3$, the air aspirating pipe 6 moves to a height $H_3$ and the funnel 3 is removed from the powder container at a position F. At a position G, the powder container is fed to the belt conveyer.

Further, the present invention is not limited to these embodiments, but various variations and modifications may be made without departing from the scope of the present invention.

What is claimed is:

1. A powder filling method, comprising the steps of:

inserting an air aspirating pipe in a powder container filled with a toner powder;

aspirating air in said powder through said air aspirating pipe;

moving one end of said air aspirating pipe from a bottom portion to a top portion of said powder container, corresponding to an amount of said powder filled in said container; connecting airtightly one of a hopper and a funnel to said powder container through a nozzle, one of said hopper and said funnel being filled with said powder, one of said hopper and said funnel having a discharge hole at a bottom thereof connected to said powder container through said nozzle; blowing air from a wall of said nozzle into said powder container; filling said powder container from one of said hopper or said funnel; and aspirating said air in said powder container through said air aspirating pipe through a hole formed in said powder container.

2. A powder filling device comprising:

a powder container having a powder inlet and an air aspirating pipe insertion hole;

an air aspirating pipe positioned in said powder container, said air aspirating pipe having an air separating portion having a plurality of pores for separating air in said powder in said powder container; and means for moving said air separating portion from a bottom portion to a top portion of said powder container.

3. The powder filling device according to claim 2, further comprising:

a nozzle having a plurality of pores for blowing air; and one of a hopper and a funnel connected airtightly to said powder container through said nozzle, one of said hopper and said funnel being filled with said powder, one of said hopper and said funnel having a discharge hole at a bottom thereof connected to said powder container through said nozzle.

4. The powder filling device according to claim 2, further comprising one of a sieve and a filter provided around said air separating portion.

5. The powder filling device according to claim 2, wherein said powder inlet of said powder container has a diameter less than 6 mm and said air aspirating pipe insertion hole has a diameter less than 6 mm.

6. The powder filling device according to claim 2, further comprising a compressed air source connected to said air aspirating pipe, said compressed air source providing compressed air to said air separating portion through said air aspirating pipe.

7. The powder filling device according to claim 2, wherein said powder is a toner.

8. A powder filling method, comprising the steps of:

inserting an air aspirating pipe in a powder container filled with a powder;

aspirating air in said powder through said air aspirating pipe; and moving one end of said air aspirating pipe from a bottom portion to a top portion of said powder container while aspirating air in said powder, corresponding to an amount of said powder filled in said container.

* * * * *